US007770818B2

(12) United States Patent
Kurimoto et al.

(10) Patent No.: US 7,770,818 B2
(45) Date of Patent: Aug. 10, 2010

(54) FUEL INJECTION VALVE

(75) Inventors: Naoki Kurimoto, Kariya (JP); Tetsuya Toyao, Kariya (JP); Shuichi Matsumoto, Kariya (JP); Kouichi Oohata, Kariya (JP)

(73) Assignee: Denso Corporation, Kariya (JP)

( * ) Notice: Subject to any disclaimer, the term of this patent is extended or adjusted under 35 U.S.C. 154(b) by 191 days.

(21) Appl. No.: 12/010,794

(22) Filed: Jan. 30, 2008

(65) Prior Publication Data

US 2008/0191062 A1 Aug. 14, 2008

(30) Foreign Application Priority Data

Feb. 8, 2007 (JP) ..... 2007-029564
Nov. 2, 2007 (JP) ..... 2007-286517

(51) Int. Cl.
*F02M 41/16* (2006.01)

(52) U.S. Cl. ..... 239/96; 239/102.2; 239/533.3; 239/533.9; 239/584; 123/446; 123/467

(58) Field of Classification Search ..... 239/88, 239/533.3, 533.8, 533.9, 533.12, 584, 96, 239/102.2; 123/446, 467
See application file for complete search history.

(56) References Cited

U.S. PATENT DOCUMENTS 5,842,640 A * 12/1998 Ganser ..... 239/533.9
6,213,098 B1 * 4/2001 Kato et al. ..... 123/467
6,422,210 B1 7/2002 Lambert et al.
6,705,551 B1 3/2004 Kienzler
6,928,985 B2 8/2005 Boecking
6,994,273 B2 2/2006 Ganser et al.
2004/0025842 A1 2/2004 Boecking

FOREIGN PATENT DOCUMENTS

AT 500889 4/2006
DE 10337609 3/2005

OTHER PUBLICATIONS

German Office Action dated Feb. 19, 2009, issued in corresponding German Application No. 10 2008 000 235.6-13, with English translation.
Japanese Office Action dated Jan. 27, 2009 issued in corresponding Japanese Application No. 2007-286517, with English translation.
Chinese Office Action dated Jan. 22, 2010, issued in corresponding Chinese Application No. 200810004893.1, with English translation.

* cited by examiner

*Primary Examiner*—Steven J Ganey
(74) *Attorney, Agent, or Firm*—Nixon & Vanderhye PC

(57) ABSTRACT

A fuel injection valve includes a housing having a wall surface on an opposite side of the nozzle hole. A fuel passage opens in the wall surface, and communicates with a nozzle hole through a nozzle cavity. The nozzle cavity accommodates a valve element. A cylinder is substantially in contact with the wall surface at one end, and slidably accommodating one end of the valve element. The cylinder partitions the nozzle cavity substantially into a fuel accumulator chamber and a pressure control chamber. The fuel accumulator chamber accumulates fuel supplied from the fuel passage. The pressure control chamber accumulates fuel for manipulating the valve element. The cylinder has an outer wall defining a deflecting surface for radially outwardly deflecting fuel flowing from the fuel passage.

7 Claims, 6 Drawing Sheets

FUEL INJECTION VALVE

CROSS REFERENCE TO RELATED APPLICATIONS

This application is based on and incorporates herein by reference Japanese Patent Applications No. 2007-29564 filed on Feb. 8, 2007 and No. 2007-286517 filed on Nov. 2, 2007.

FIELD OF THE INVENTION

The present invention relates to a fuel injection valve.

BACKGROUND OF THE INVENTION

According to U.S. Pat. No. 6,705,551 B1 (JP-A-2003-506622), as shown in FIG. 7, a fuel injection valve 100 has a fuel accumulator chamber 180 and a pressure control chamber 190 partitioned from each other by a cylinder 200. The fuel accumulator chamber 180 has a nozzle cavity 120 accommodating a valve element (needle) 140 adapted to opening and closing nozzle holes 130. The nozzle cavity 120 accumulates high-pressure fuel to be injected through the nozzle holes 130. The pressure control chamber 190 accumulates high-pressure fuel for controlling the opening and closing of the nozzle holes 130 using the needle 140.

The cylinder 200 of the fuel injection valve 100 is substantially in a cylindrical shape. The cylinder 200 has one end being in contact with a counter-nozzle hole wall surface 340 on the opposite side of the nozzle cavity 120. The needle 140 is slidably inserted in the inner circumferential periphery of the cylinder 200. In the present structure, the inner circumferential periphery of the cylinder 200 defines the pressure control chamber 190, and the outer wall of the cylinder 200 defines the fuel accumulator chamber 180. The movement of the needle 140 is controlled by manipulating pressure in the pressure control chamber 190, thereby intermittence of fuel injection from the nozzle holes 130 is controlled. The other end of the cylinder 200 has a spring seat 250 for supporting a spring 160. The spring 160 maintains the cylinder 200 in contact with the wall surface 340.

A fuel passage 310 opens in the wall surface 340 defining the nozzle cavity 120 for supplying high-pressure fuel to the fuel accumulator chamber 180. High-pressure fuel is supplied from the fuel passage 310 into the fuel accumulator chamber 180 every time when the needle 140 opens and closes the nozzle holes 130. The one end of the cylinder 200 is biased to the wall surface 340 by the spring 160 or the like. The cylinder 200 partitions the nozzle cavity 120 into the fuel accumulator chamber 180 and the pressure control chamber 190 by being biases from the spring 160. The area of the one end of the cylinder 200 is set small to enhance contact pressure relative to the wall surface 340. The other end of the cylinder 200 has the spring seat 250 for supporting the spring 160. The outer diameter of the one end of the cylinder 200 is less than the outer diameter of the other end of the cylinder 200. The inner diameter of the cylinder 200 is constant from the one end to the other end. The outer wall of the cylinder 200 has a step portion 230 in which the outer diameter of the cylinder 200 changes.

In the structure of U.S. Pat. No. 6,705,551 B1, as shown in FIG. 7, the step portion 230 is located immediately downstream of the wall surface 340 defining the nozzle cavity 120. Accordingly, when high-pressure fuel is supplied from through the fuel passage 310 opening on the wall surface 340, the flow of high-pressure fuel collides against the step portion 230 of the cylinder 200. Consequently, the cylinder 200 may move downward, and the cylinder 200 may be displaced away from the wall surface 340. When the cylinder 200 is moved away from the wall surface 340, the fuel accumulator chamber 180 communicates with the pressure control chamber 190. Consequently, pressure in the pressure control chamber 190 cannot be properly controlled. As a result, the needle 140 cannot be accuracy controlled to properly open and close the nozzle holes 130.

SUMMARY OF THE INVENTION

In view of the foregoing and other problems, it is an object of the present invention to produce a fuel injection valve having a nozzle cavity accommodating a needle, the needle capable of being stably controlled for producing accurate fuel injection.

According to one aspect of the present invention, a fuel injection valve comprises a housing having a tip end defining a nozzle hole. The housing further has a wall surface on an opposite side of the nozzle hole. The housing further has a fuel passage opening in the wall surface. The fuel passage communicates with the nozzle hole through a nozzle cavity. The fuel injection valve further comprises a valve element accommodated in the nozzle cavity for opening and closing the nozzle hole. The fuel injection valve further comprises a cylinder having one end substantially in contact with the wall surface. The cylinder has an inner circumferential periphery slidably accommodating one end of the valve element. The cylinder partitions the nozzle cavity substantially into a fuel accumulator chamber and a pressure control chamber. The fuel accumulator chamber is adapted to accumulating fuel supplied from the fuel passage. The pressure control chamber is adapted to accumulating fuel for manipulating the valve element. The cylinder has an outer wall defining a deflecting surface adapted to radially outwardly deflecting fuel flowing from the fuel passage.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
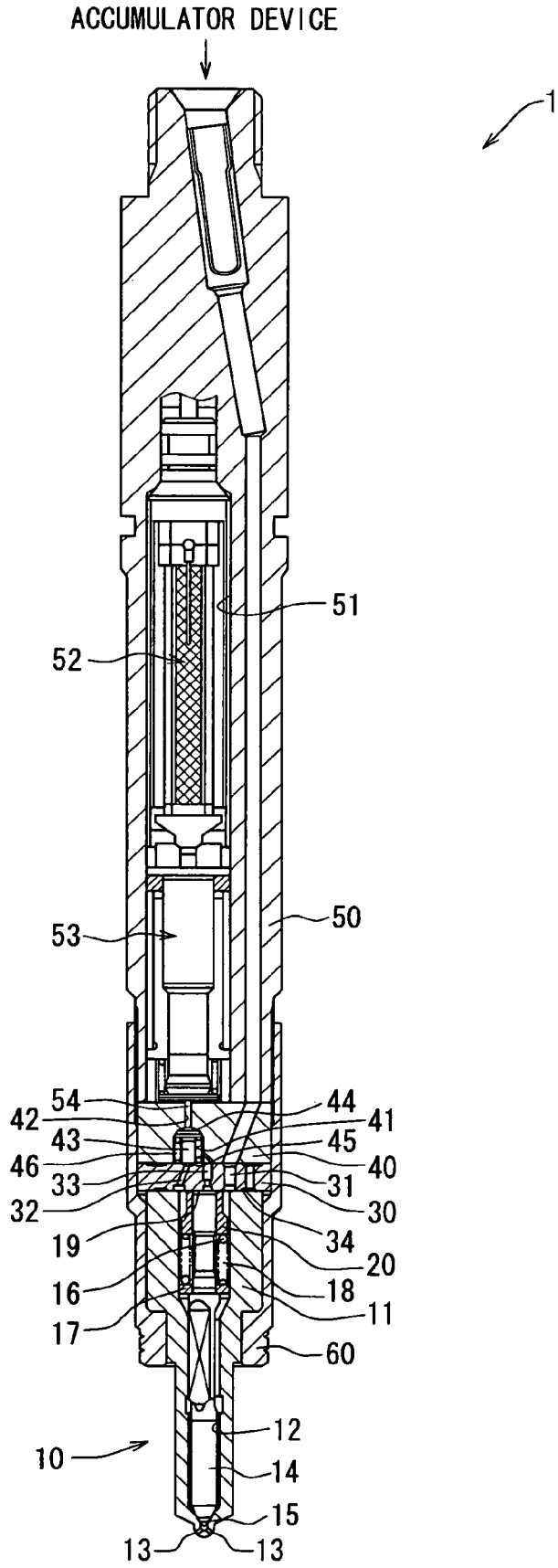
FIG. 1 is a sectional view showing a fuel injection valve according to a first embodiment.

As shown in FIG. 1, the fuel injection valve 1 is used for an accumulator fuel injection device of a diesel engine, for example. The fuel injection valve 1 is supplied with high-pressure fuel from an accumulator device (common rail, not shown). The fuel injection valve 1 injects the high-pressure fuel to a combustion chamber of the engine. Fuel injection valve 1 includes an injection nozzle 10, an orifice plate 30, a valve body 40, a control valve 43, a lower body 50, a piezo actuator 52, a driving force transmission part 53, and the like. The injection nozzle 10, the orifice plate 30, the valve body 40, and the lower body 50 are stacked from the lower side in this order and screwed to each other with a retaining nut 60, thereby constructed to the fuel injection valve 1. The injection nozzle 10 includes a nozzle body 11, a needle 14, a cylinder 20, and a coil spring 16. The nozzle body 11 has a nozzle cavity 12 extending from the upper end closely to the lower end thereof. The orifice plate 30 is provided to the upper end of the nozzle body 11, thereby the nozzle body 11 therein defines a closed space as the nozzle cavity 12. The lower end of the nozzle body 11 has nozzle holes 13, which communicate the nozzle cavity 12 with the exterior of the nozzle body 11. The needle 14, the coil spring 16, and the cylinder 20 are accommodated in the nozzle cavity 12.

The needle 14 as a valve element is substantially in a rod shape. The tip end of the needle 14 is provided with a valve element portion 15 adapted to being seated to and lifted from a lower end of the nozzle cavity 12 for controlling fuel injection from the nozzle holes 13. The needle 14 has an end on the opposite side of the valve element portion 15, and the end is provided with the cylinder 20 substantially in a cylindrical shape and slidably supporting the needle 14. The structure of the cylinder 20 will be described later.

The needle 14 has the upper end and the lower end (valve element portion 15) therebetween defining a step provided with a supporter ring 17 for supporting the lower end of the coil spring 16. The upper end of the coil spring 16 is supported by the cylinder 20. The coil spring 16 is axially compressed between the supporter ring 17 and the cylinder 20. In the present structure, the cylinder 20 is biased to a lower end face 34 of the orifice plate 30. The needle 14 is biased downward in a closing direction. The lower end face 34 defines a wall surface (counter-nozzle-hole wall surface) of a nozzle cavity on the opposite side of the nozzle holes 13.

The needle 14, the coil spring 16, and the cylinder 20 are accommodated in the nozzle cavity 12. The inner wall defining the nozzle cavity 12 and the outer walls of the needle 14 and the cylinder 20 therebetween define a fuel accumulator chamber 18. The upper end of the needle 14, the inner periphery of the cylinder 20, and the lower end face 34 of the orifice plate 30 thereamong define a pressure control chamber 19.

The fuel accumulator chamber 18 accumulates high-pressure fuel to be injected through the nozzle holes 13, and adapted to communicating with the nozzle holes 13. When the needle 14 is seated to the lower end defining the nozzle cavity 12, the fuel accumulator chamber 18 is blocked from the nozzle holes 13, thereby fuel injection from the nozzle holes 13 is stopped. When the needle 14 is lifted from the lower end, the fuel accumulator chamber 18 communicates with the nozzle holes 13, thereby fuel is sprayed through the nozzle holes 13.

The pressure control chamber 19 accumulates high-pressure fuel for controlling axial movement of the needle 14. Fuel is supplied to the pressure control chamber 19, thereby applying hydraulic pressure onto the upper end of the needle 14 to downwardly bias the needle 14. The control of the axial movement of the needle 14 will be described later.

The orifice plate 30 is substantially in a disc shape, and is located between the nozzle body 11 and the valve body 40. The orifice plate 30 has a fuel passage 31, a first communication passage 32, and a second communication passage 33 each extending from one end surface of the orifice plate 30 to the other end surface of the orifice plate 30.

The fuel passage 31 axially extends through the valve body 40 and the lower body 50 to lead high-pressure fuel from the accumulator device into the fuel accumulator chamber 18. The fuel passage 31 opens in the lower body 50 and communicates with the accumulator device.

The first communication passage 32 communicates the fuel accumulator chamber 18 with a valve chamber 41 provided in the valve body 40. The lower end face 34 of the orifice plate 30 has a substantially annular groove having a bottom communicated with the fuel passage 31 and the first communication passage 32. The second communication passage 33 communicates the pressure control chamber 19 with the valve chamber 41.

The valve body 40 is substantially in a disc shape, and is located between the orifice plate 30 and the lower body 50. The valve body 40 has the lower end face via which the valve body 40 is in contact with the orifice plate 30. The valve chamber 41 is opened in the lower end face of the valve body 40. The lower end of the valve chamber 41 communicates with the first and second communication passages 32, 33. The upper end of the valve chamber 41 communicates with a third communication passage 42. The third communication passage 42 further communicates with a longitudinal cavity 51 provided in the lower body 50.

The valve chamber 41 accommodates the control valve 43 and a coil spring 46 for controlling a flow of fuel in the first, second, and third communication passages 32, 33, 42. The upper side of the control valve 43 is provided with a low-pressure seat 44. The lower side of the control valve 43 is provided with a high-pressure seat 45.

When the low-pressure seat 44 is seated to the upper end surface defining the valve chamber 41, the opening of the third communication passage 42 is closed. Thereby, the fuel accumulator chamber 18, the second communication passage 33, the valve chamber 41, and the first communication passage 32 define a first path communicating with the pressure control chamber 19. Thus, high-pressure fuel is supplied from the fuel accumulator chamber 18 into the pressure control chamber 19 through the first path.

On the other hand, when the high-pressure seat 45 is seated to the lower end face defining the valve chamber 41, the opening of the first communication passage 32 is closed, and the opening of the third communication passage 42 is opened. Thereby, the pressure control chamber 19, the second communication passage 33, the valve chamber 41, and the third communication passage 42 define a second path communicating with the longitudinal cavity 51 of the lower body 50. Thus, high-pressure fuel is discharged from the pressure control chamber 19 into the longitudinal cavity 51, which is low in pressure, through the second path. Consequently, pressure in the pressure control chamber 19 decreases. Thus, pressure in the pressure control chamber 19 can be controlled by manipulating the control valve 43.

The lower body 50 has the longitudinal cavity 51 extending in the axial direction thereof, and the longitudinal cavity 51 accommodates the piezo actuator 52 and the driving force transmission part 53. The lower body 50 has the lower end face supporting the valve body 40. The piezo actuator 52 is constructed by alternately laminating a piezo-electric ceramic layer and an electrode layer such as PZT. The piezo actuator 52 is expanded and contracted in a laminating direction (vertical direction) by being charged with electricity and discharging electricity in response to a control of a drive circuit (not shown). The longitudinal cavity 51 is connected with a low-pressure component such as a fuel tank through a hydraulic passage (not shown).

The driving force transmission part 53 is located on the lower side of the piezo actuator 52. The driving force transmission part 53 transmits expansion of the piezo actuator 52 to the control valve 43 via a pin 54 accommodated in the third communication passage 42.

The piezo actuator 52 is axially expanded when being charged with electricity. The driving force transmission part 53 transmits the expansion of the piezo actuator 52 to the control valve 43 via the pin 54. The control valve 43 is biased downward via the pin 54, thereby the low-pressure seat 44 of the control valve 43 is lifted from the upper end surface defining the valve chamber 41. The high-pressure seat 45 of the control valve 43 is seated to the lower end face defining the valve chamber 41, thereby the opening of the first communication passage 32 is closed. Thus, high-pressure fuel is discharged from the pressure control chamber 19 to a low-pressure component through the second path.

The piezo actuator 52 is axially contracted when discharging electricity. The control valve 43 and the pin 54 upwardly move by being biased from the coil spring 46 in response to the contraction of the piezo actuator 52. The control valve 43 moves upward, so that the high-pressure seat 45 of the control valve 43 is lifted from the lower end face defining the valve chamber 41. The low-pressure seat 44 of the control valve 43 is seated to the upper end surface defining the valve chamber 41, thereby the opening of the third communication passage 42 is closed. Thus, high-pressure fuel is supplied from the fuel accumulator chamber 18 into the pressure control chamber 19 through the first path.

Next, an operation of the fuel injection valve 1 is described. When the piezo actuator 52 discharges electricity, the control valve 43 closes the opening of the third communication passage 42, thereby high-pressure fuel supplied from the accumulator device to the fuel injection valve 1 flows into the fuel accumulator chamber 18 through the fuel passage 31. The high-pressure fuel is further supplied into the pressure control chamber 19 through the second communication passage 33, the valve chamber 41, and the first communication passage 32.

In the present condition, the needle 14 is exerted with force from high-pressure fuel in the pressure control chamber 19 via the upper end surface of the needle 14, thereby being biased downward in the closing direction. The needle 14 is also exerted with biasing force of the coil spring 16, thereby being biased downward. The needle 14 is further exerted with force of high-pressure fuel in the fuel accumulator chamber 18 in vicinity of the valve element portion 15, thereby being biased upward in the opening direction. In the present condition, force exerted to the needle 14 downward is greater than force exerted to the needle 14 upward. Therefore, the valve element portion 15 is seated to the lower end defining the nozzle cavity 12, and fuel is not injected from the nozzle holes 13.

When the piezo actuator 52 is charged with electricity, the control valve 43 is biased downward via the pin 54, thereby the high-pressure seat 45 of the control valve 43 closes the opening of the first communication passage 32. The low-pressure seat 44 of the control valve 43 communicates the opening of the third communication passage 42. Thus, high-pressure fuel is discharged from the pressure control chamber 19 to a low-pressure component through the second path, and pressure in the pressure control chamber 19 starts decreasing.

When pressure in the pressure control chamber 19 decreases to valve-opening-pressure, the force exerted to the needle 14 upward becomes greater than the force exerted to the needle 14 downward. Thus, the needle 14 is lifted upward, and the valve element portion 15 is also lifted from the lower end defining the nozzle cavity 12, thereby fuel is injected through the nozzle holes 13.

When the piezo actuator 52 discharges electricity again, the control valve 43 closes the opening of the third communication passage 42, and communicates the opening of the first communication passage 32. Thus, high-pressure fuel is again supplied from the fuel accumulator chamber 18 into the pressure control chamber 19 through the first path, and pressure in the pressure control chamber 19 again increases.

When pressure in the pressure control chamber 19 increases to valve-closing pressure, the force exerted to the needle 14 downward becomes greater than the force exerted to the needle 14 upward. Thus, the needle 14 moves downward, and the needle 14 is seated to the tip end defining the nozzle cavity 12, thereby fuel injection from the nozzle holes 13 is terminated.

Figure 2:
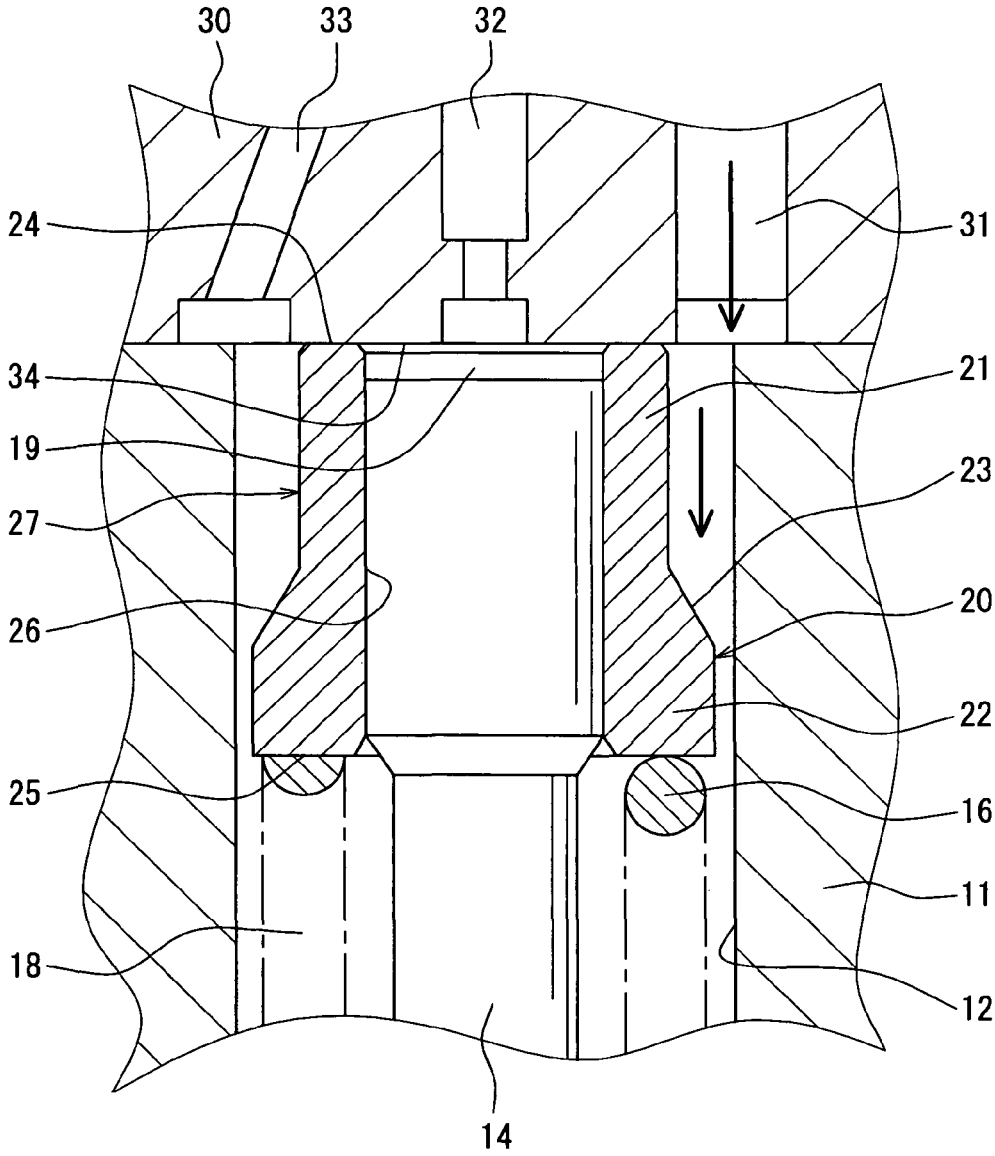
FIG. 2 is a sectional view showing a main portion of the fuel injection valve according to the first embodiment.

Next, a feature of the present embodiment is described in detail with reference to FIG. 2. As shown in FIG. 2, the cylinder 20 is substantially in a cylindrical shape, and includes a large diameter portion 22 and a small diameter portion 21. The large diameter portion 22 is greater than the small diameter portion 21 in outer diameter. The small diameter portion 21 is relatively small in outer diameter.

The end of the small diameter portion 21 has a contact portion 24 being in contact with the lower end face 34 of the orifice plate 30. The lower end face 34 of the orifice plate 30 defines the upper end surface of the nozzle cavity 12. The end of the large diameter portion 22 defines a spring seat 25 as a seat of the coil spring 16. The thickness of the spring seat 25 is substantially equal to or greater than the diameter of the wire of the coil spring 16 for supporting the coil spring 16. By contrast, the thickness of the contact portion 24 is less than the thickness of the spring seat 25. In the present structure, the contact portion 24 is in contact with the lower end face 34, and contact pressure of the contact portion 24 relative to the lower end face 34 can be enhanced, so that the cylinder 20 can be further tightly in contact with the orifice plate 30.

The inner periphery of the cylinder 20 defines a guide plane 26 for slidably supporting the upper end of the needle 14. The diameter of the guide plane 26 is substantially constant from the contact portion 24 to the spring seat 25. The outer wall of the cylinder 20 has a step portion 23 between the small diameter portion 21 and the large diameter portion 22. The step portion 23 defines a slope where the outer diameter of the cylinder 20 gradually increases from the small diameter portion 21 toward the large diameter portion 22.

The outer wall of the small diameter portion 21 has a deflecting surface 27. The fuel accumulator chamber 18 is supplied with fuel flowing from the fuel passage 31 opened in the lower end face 34 of the orifice plate 30, and the deflecting surface 27 deflects the flow of high-pressure fuel radially outwardly on the cylinder 20. An operation effect of the deflecting surface 27 will be described later.

Next, an operation effect of the cylinder 20 is described. As described above, the control valve 43 is operated to decrease pressure in the pressure control chamber 19 to the valve-closing pressure, thereby moving the needle 14 upward. Thus, the valve element portion 15 is lifted from the lower end defining the nozzle cavity 12, so that high-pressure fuel is injected through the nozzle holes 13. The amount of fuel in the fuel accumulator chamber 18 decreases by at least an amount of fuel injected through the nozzle holes 13. As shown by the arrow in FIG. 2, the fuel accumulator chamber 18 is supplied with new high-pressure fuel through the fuel passage 31.

The fuel flows through the fuel passage 31, and the fuel flow collides against the deflecting surface 27 on the outer wall of the small diameter portion 21, thereby the fuel flow is deflected radially outward on the cylinder 20. As shown in FIG. 2, the deflecting surface 27 is substantially in parallel with a streamline, i.e., flow line of the fuel flow. Therefore, the angle between the streamline of the fuel flow and the deflecting surface 27 is significantly small. Thus, even when the fuel flow collides against the deflecting surface 27, the deflecting surface 27 is capable of turn kinetic energy of the fuel flow away from the deflecting surface 27. In the present structure, the deflecting surface 27 is capable of suppressing force exerting to bias the cylinder 20 downward when the fuel flow collides.

In the present structure, the contact portion 24 of the cylinder 20 can be steadily in contact with the lower end face 34 of the orifice plate 30. As a result, controllability of pressure in the pressure control chamber 19 can be enhanced, so that the needle 14 can be further accuracy controlled.

The deflecting surface 27 extends substantially in the axial direction. Therefore, the step portion 23 provided between the small diameter portion 21 and the large diameter portion 22 can be located distant from the fuel passage 31. The kinetic energy of the fuel flow from the fuel passage 31 is reduced before the fuel flow reaches the step portion 23. Therefore, the force, which is caused by collision of the fuel flow against the step portion 23 to bias the cylinder 20 downward, can be reduced. In addition, the step portion 23 is a slope that increases in outer diameter from the small diameter portion 21 toward the large diameter portion 22. Therefore, the step portion 23 itself is capable of defusing the kinetic energy of the fuel flow. Furthermore, the deflecting surface 27 is provided circumferentially throughout the outer wall of the cylinder 20. Therefore, the circumferential position of the deflecting surface 27 need not be aligned with respect to the fuel passage 31 when the cylinder 20 is attached into the nozzle cavity 12. Thus, manufacturing work can be facilitated.

In the present embodiment, the piezo actuator 52 and the driving force transmission part 53 are provided as a driving device to manipulate the control valve 43 by transmitting the expansion of the piezo actuator 52. Alternatively, an electromagnetism actuator may be employed as the driving device. In the present embodiment, the control valve 43 is a two-position three-way valve. Alternatively, the control valve 43 may be a two-position two-way valve.

Figure 3:
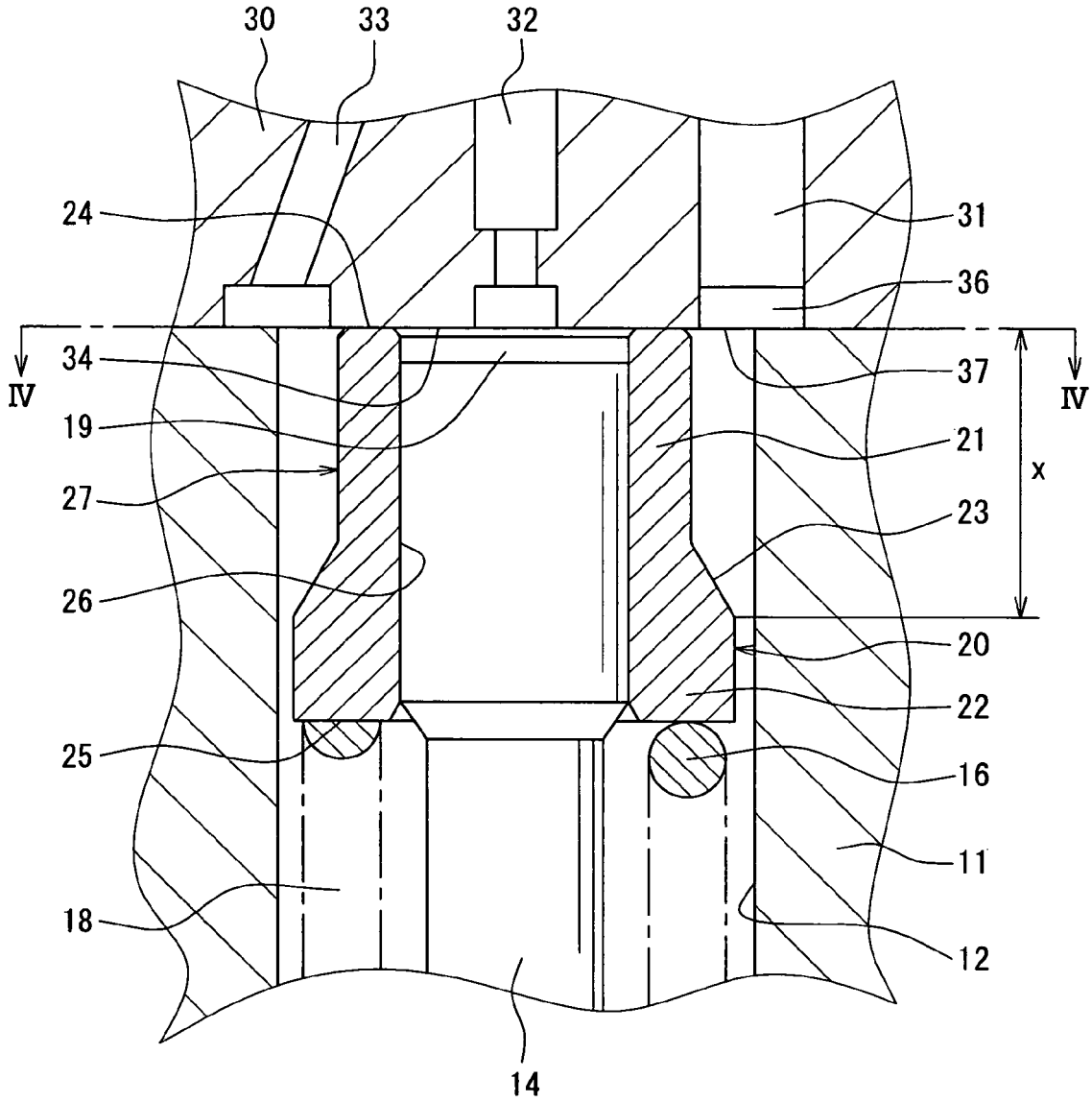
FIG. 3 is a sectional view showing a main portion of the fuel injection valve according to the first embodiment.
Figure 4:
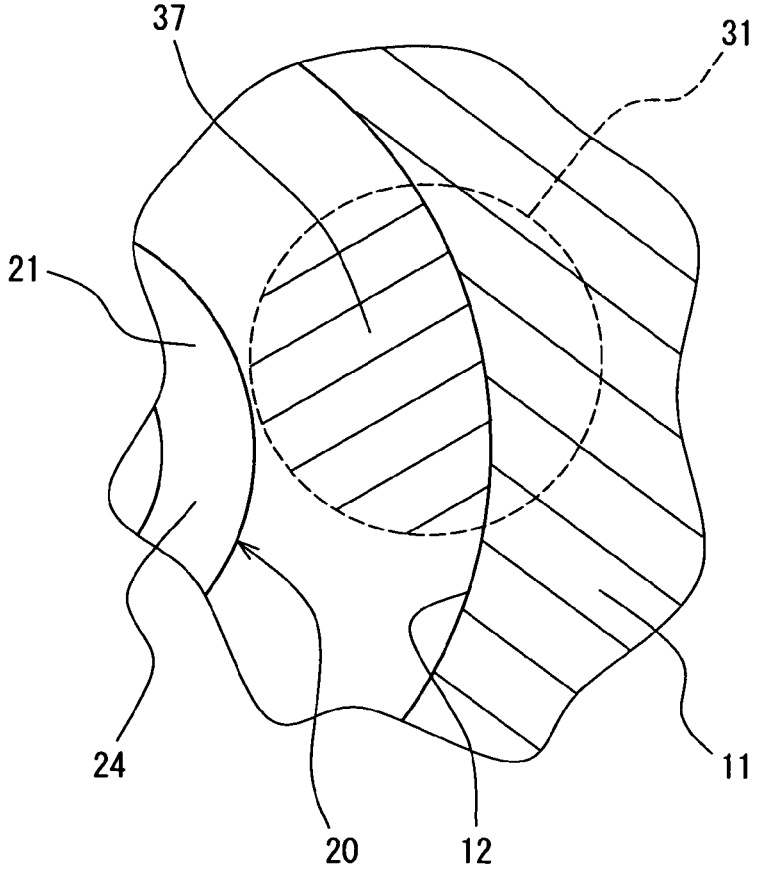
FIG. 4 is a sectional view taken along a line IV-IV in FIG. 3.

Next, a relationship between the diameter of an opening 37 of the fuel passage 31 opened to the nozzle cavity 12 and the distance from the opening 37 to the step portion 23 of the cylinder 20 is described with reference to FIGS. 3 to 5. In present embodiment, as shown in FIGS. 3, 4, the diameter of the fuel passage 31 is greater than the distance between the outer wall of the small diameter portion 21 of the cylinder 20 and the inner wall defining the nozzle cavity 12. Accordingly, a part of an open end 36 of the fuel passage 31 and the nozzle body 11 overlap one another. Therefore, the passage area of the opening 37 of the fuel passage 31 opened to the nozzle cavity 12 is less than the passage area of the open end 36. In the present structure, as shown in FIG. 4, a part of the open end 36 and the nozzle body 11 overlap one another, and hence, the opening 37 is not in a circular shape. Specifically, as shown by the hatched area between the cylinder 20 and the nozzle cavity 12, a part of the circular part of the opening 37 is cut out by the inner wall defining the nozzle cavity 12.

Referring to FIG. 3, the deflecting surface 27 can be elongated by increasing the length of the small diameter portion 21 with respect to the axial direction thereof. In addition, the step portion 23 can be located further distant from the opening 37 by elongating the small diameter portion 21 with respect to the axial direction length. Thereby, an influence of the fuel flow from the opening 37 against the step portion 23 can be reduced. Thus, the contact portion 24 of the cylinder 20 can be restricted from moving away from the lower end face 34 of the orifice plate 30.

Figure 5:
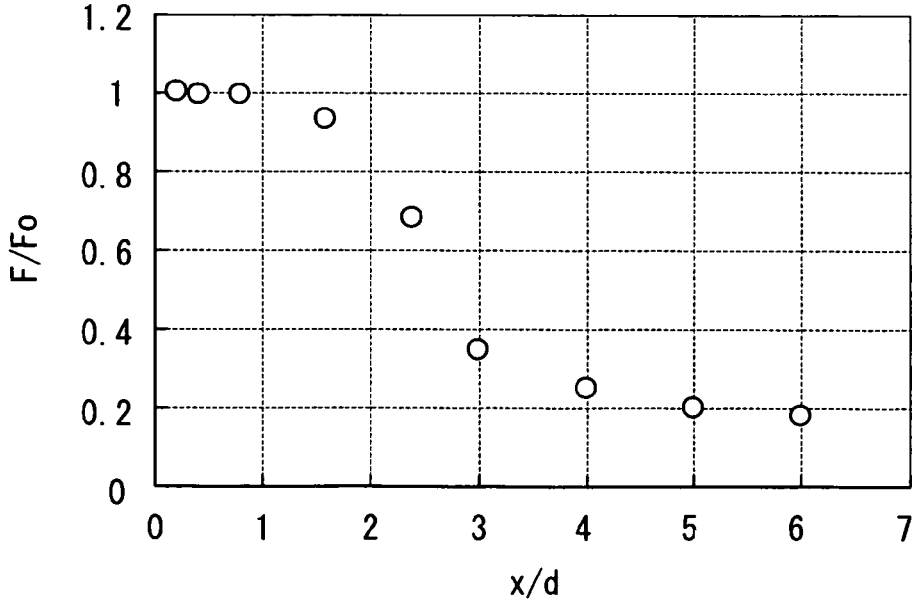
FIG. 5 is a graph showing a relationship between a ratio x/d and a ratio F/F0.

FIG. 5 is a graph showing a relationship between a ratio x/d and a ratio F/F0. The ratio x/d is calculated by dividing the distance x from the opening 37 to the step portion 23 by the opening diameter d of the opening 37. The ratio F/F0 is calculated by dividing load F exerted to the step portion 23 of the cylinder 20 and collision load F0 exerted from the fuel flow immediately downstream of the opening 37. In FIG. 5, the opening diameter d is a hydraulic equivalent diameter, which is a diameter of a circular pipe equivalent to the opening 37. Specifically, the opening diameter d can be calculated by the following equation (1), in which A denotes the opening area of the opening 37, and L denote a wetted perimeter of the opening 37.

$$d=4A/L \tag{1}$$

The distance x is a span from the opening 37 to a location in the step portion 23 where velocity of the fuel flow is highest in a flow distribution of the fuel flow from the opening 37. In the present embodiment, as shown in FIG. 3, the distance x is the span from the opening 37 to the end of the step portion 23 on the side of the large diameter portion 22. The collision load F0 of the fuel flow can be calculated by the following equation (2). In the equation (2), ρ denotes the density of fuel, and u denotes the flow velocity of fuel in the opening 37.

$$F0=\int_A\left(\frac{\rho}{2}u^2\right)ds \tag{2}$$

The load F exerted to the step portion 23 is an integrated value of pressure distribution in the step portion 23. The pressure distribution in the step portion 23 may be obtained by a simulation or the like.

As shown in FIG. 5, as the value of x/d becomes large, the value of F/F0 becomes small. That is, as the distance x becomes large relative to a specific value of the opening diameter d, the influence of the fuel flow against the cylinder 20 becomes small. According to the graph in FIG. 5, the value of F/F0 significantly decreases when the value of x/d is equal to or greater than 2. When the value of the x/d is greater than 3, that is, in a range where the relation of $x \geqq 3d$ is satisfied, the value of F/F0 becomes constant at a lower value less than 0.4. Accordingly, the distance x is preferably equal to or greater than 3d.

Second Embodiment

Figure 6:
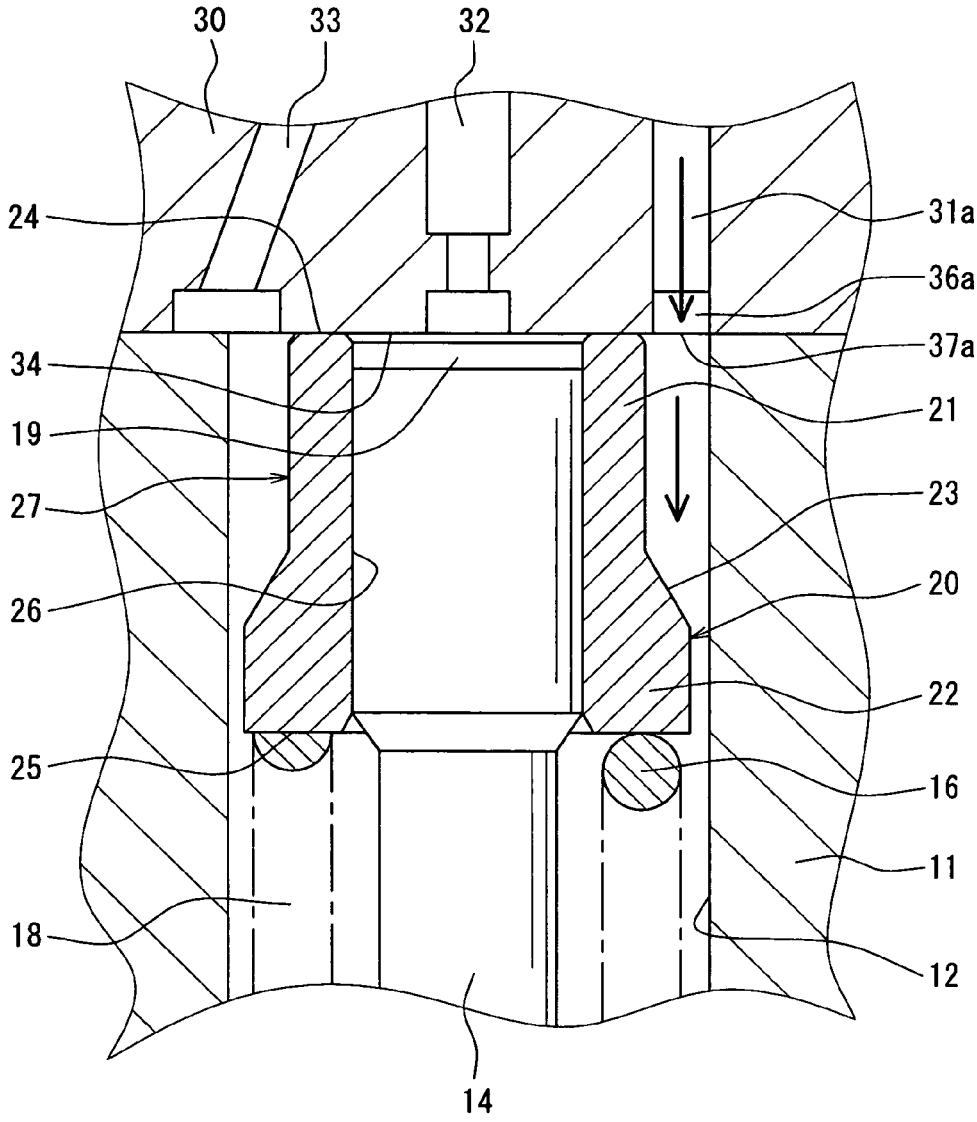
FIG. 6 is a sectional view showing a main portion of the fuel injection valve according to a second embodiment.
Figure 7:
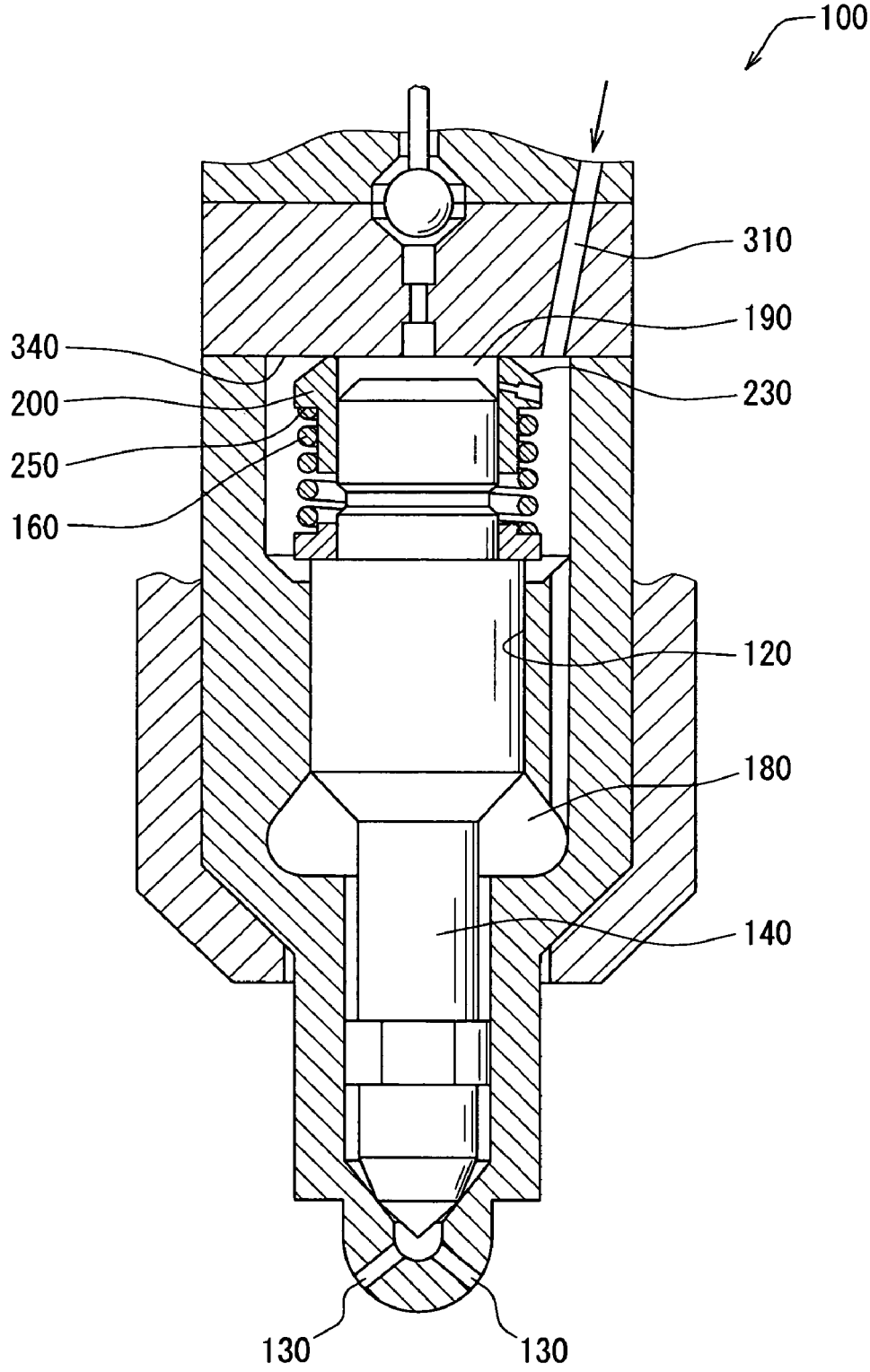
FIG. 7 PRIOR ART
FIG. 7 is a sectional view showing a fuel injection valve according to a prior art.

As shown in FIG. 6, in the second embodiment, a fuel passage 31*a* is different from the fuel passage 31 in the first embodiment. The diameter of an open end 36*a* of the fuel passage 31*a* is equal to or less than the distance between the outer wall of the small diameter portion 21 of the cylinder 20 and the inner wall defining the nozzle cavity 12. The distance from the center axis of the nozzle cavity 12 to the inner wall defining the fuel passage 31*a* on the radially outer side substantially coincides with the distance from the center axis of the nozzle cavity 12 to the inner wall defining the nozzle cavity 12.

That is, the nozzle cavity 12 has an imaginary center axis at a first distance radially from a first inner wall defining the fuel passage 31*a* on a radially outer side. The imaginary center axis of the nozzle cavity 12 is at a second distance radially from a second inner wall defining the nozzle cavity 12. The first distance is substantially equal to the second distance. Alternatively, the first distance may be equal to or less than the second distance.

In the present structure, the open end 36*a* of the fuel passage 31*a* and the nozzle body 11 do not overlap one another, dissimilarly to the first embodiment. Therefore, the passage area of an opening 37*a* of the fuel passage 31*a* communicating with the nozzle cavity 12 is substantially equal to the passage area of the open end 36*a*. Thus, the opening diameter d of the opening is substantially the same as the diameter of the open end 36*a* of the fuel passage 31*a* and the diameter of the opening 37*a*.

In this case, the force exerted to the step portion 23 also shows a tendency similarly to the relationship shown in FIG. 5. Specifically, influence of the fuel flow passing from the opening 37*a* can be significantly reduced in a range where the relation of $x \geqq 3d$ is satisfied, thereby the contact portion 24 of the cylinder 20 can be restricted from detached away from the lower end face 34 of the orifice plate 30.

The number of the nozzle hole 13 may be one.

The above structures of the embodiments can be combined as appropriate. It should be appreciated that while the processes of the embodiments of the present invention have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

What is claimed is:

1. A fuel injection valve comprising:

a housing having a tip end defining a nozzle hole, the housing further having a wall surface on an opposite side of the nozzle hole, the housing further having a fuel passage opening in the wall surface, the fuel passage communicating with the nozzle hole through a nozzle cavity;

a valve element accommodated in the nozzle cavity for opening and closing the nozzle hole;

a cylinder having one end substantially in contact with the wall surface, the cylinder having an inner circumferential periphery slidably accommodating one end of the valve element, the cylinder partitioning the nozzle cavity substantially into a fuel accumulator chamber and a pressure control chamber; and a spring for biasing the cylinder to the wall surface, wherein the fuel accumulator chamber is adapted to accumulating fuel supplied from the fuel passage, the pressure control chamber is adapted to accumulating fuel for manipulating the valve element, the cylinder has an outer wall defining a deflecting surface adapted to radially outwardly deflecting fuel flowing from the fuel passage, the cylinder has a small diameter portion and a large diameter portion, the small diameter portion has one end having a contact portion substantially in contact with the wall surface, the large diameter portion has one end having a spring seat for supporting the spring, the small diameter portion has an outer wall defining the deflecting surface, the small diameter portion and the large diameter portion therebetween define a step portion, the fuel passage has a diameter d, the fuel passage has an opening in the wall surface, and the opening is at a distance of x from a location where fuel supplied to the nozzle cavity through the opening flows at highest flow velocity and collides against the step portion, and the deflecting surface has a length to satisfy: $x \geqq 3d$.

2. The fuel injection valve according to claim 1, wherein the outer wall of the cylinder circumferentially entirely defines the deflecting surface.

3. The fuel injection valve according to claim 1, wherein the small diameter portion and the large diameter portion therebetween define a step portion, and the step portion has an outer diameter gradually increasing from the small diameter portion toward the large diameter portion.

4. The fuel injection valve according to claim 1, wherein the deflecting surface is substantially in parallel with the fuel passage.

5. The fuel injection valve according to claim 1, wherein the deflecting surface extends substantially in parallel with the fuel passage.

6. The fuel injection valve according to claim 1, wherein the nozzle cavity has an imaginary center axis at a first distance radially from a first inner wall defining the fuel passage on a radially outer side, the imaginary center axis of the nozzle cavity is at a second distance radially from a second inner wall defining the nozzle cavity, and the first distance is equal to or less than the second distance.

7. The fuel injection valve according to claim 6, wherein the first distance is substantially equal to the second distance.

* * * * *